US006065191A

United States Patent [19]

Leifeld

[11] Patent Number: 6,065,191

[45] Date of Patent: May 23, 2000

[54] METHOD AND APPARATUS FOR SPLICING AND FEEDING SLIVERS

[75] Inventor: Martin Leifeld, Herzogenrath, Germany

[73] Assignee: Trützschler GmbH & Co. KG, Mönchengladbach, Germany

[21] Appl. No.: 09/148,628

[22] Filed: Sep. 4, 1998

[30] Foreign Application Priority Data

Sep. 8, 1997 [DE] Germany ..... 197 39 186

[51] Int. Cl.[7] ..... D04H 11/00

[52] U.S. Cl. ..... 19/159 A; 19/150; 19/157; 19/159 R

[58] Field of Search ..... 19/144, 159 A, 19/157, 159 R, 239, 65 A, 261, 243, 276, 288, 291, 292, 287, 295, 260; 28/117, 141; 57/22, 23, 261, 263

[56] References Cited

U.S. PATENT DOCUMENTS

| | | | |
|---|---|---|---|
| 4,267,620 | 5/1981 | Allen, Jr. | 19/239 |
| 4,805,287 | 2/1989 | Perini et al. | 29/407 |
| 4,875,256 | 10/1989 | Gunkinger | 19/159 A |
| 4,939,895 | 7/1990 | Raasch et al. | 57/263 |
| 4,969,323 | 11/1990 | Stahlecker . | |
| 4,982,563 | 1/1991 | Stahlecker | 19/159 A |
| 5,111,551 | 5/1992 | Hollingsworth et al. | 19/159 R |
| 5,155,987 | 10/1992 | Vogel | 57/261 |
| 5,177,835 | 1/1993 | Ogawa et al. | 19/260 |
| 5,359,758 | 11/1994 | Stahlecker et al. | 57/261 |
| 5,461,757 | 10/1995 | Leifeld | 19/239 |
| 5,488,758 | 2/1996 | Tahara et al. | 19/260 |
| 5,709,011 | 1/1998 | Baechler et al. | 19/239 |
| 5,774,942 | 7/1998 | Clapp et al. | 19/239 |

FOREIGN PATENT DOCUMENTS

| | | |
|---|---|---|
| 0 367 211 | 5/1990 | European Pat. Off. . |
| 0 400 580 | 12/1990 | European Pat. Off. . |
| 0 425 803 | 5/1991 | European Pat. Off. . |
| 0 482 475 | 4/1992 | European Pat. Off. . |
| 0 597 332 | 5/1994 | European Pat. Off. . |
| 0 603 125 | 6/1994 | European Pat. Off. . |
| 0 677 603 | 10/1995 | European Pat. Off. . |
| 0 768 398 | 4/1997 | European Pat. Off. . |
| 27 13 355 | 9/1977 | Germany . |
| 29 11 744 | 10/1979 | Germany . |
| 269 598 | 7/1989 | Germany . |
| 38 02 413 | 8/1989 | Germany . |
| 39 02 994 | 7/1990 | Germany . |
| 40 38 982 | 6/1991 | Germany . |

*Primary Examiner*—William Stryjewski
*Assistant Examiner*—Gary L. Welch
*Attorney, Agent, or Firm*—Venable; Gabor J. Kelemen

[57] ABSTRACT

An apparatus for splicing a leading end of a first sliver deposited in a coiler can and a trailing end of an out-running second sliver fed into a fiber processing machine, includes a device for tapering the leading and trailing ends to obtain gradually tapered length portions thereof; a device for positioning the tapered length portions side by side to obtain a juxtapositioned relationship thereof; a pressure-applying constriction through which the first and second slivers pass for splicing together the leading and trailing ends by pressure; and a device for introducing the first sliver, spliced to the second sliver, into the fiber processing machine.

19 Claims, 8 Drawing Sheets

METHOD AND APPARATUS FOR SPLICING AND FEEDING SLIVERS

CROSS REFERENCE TO RELATED APPLICATION

This application claims the priority of German Application No. 197 39 186.9 filed Sep. 8, 1997, which is incorporated herein by reference.

BACKGROUND OF THE INVENTION

This invention relates to a method and an apparatus for splicing and feeding fiber slivers, particularly carded or drafted slivers, drawn from coiler cans and guided by sliver advancing devices of an in-feed table to a textile processing machine, such as a drawing frame, a combing machine or the like in which the leading end of the sliver contained in a full coiler can may be attached to the trailing end of a running sliver. The leading and trailing sliver ends may be introduced into a compressing constriction (gap).

In practice, during the exchange of coiler cans of a first drafting passage (and, if present, also of a second drafting passage), the insertion of the sliver into the in-feed table has been performed manually. With the process automation in the spinning technology all transporting steps for coiler cans may be carried out in a program-controlled manner. Consequently, it is a desideratum to automatically exchange the coiler cans at the drafting frame, including an automatic insertion, positioning and splicing of the slivers.

In a known apparatus, a standby sliver is held in readiness at the transport path of the sliver. When the advancing sliver breaks or runs out, a control unit activates the standby sliver such that its leading end may be attached to the trailing end of the out-running sliver. The leading end of the standby sliver and the trailing end of the outrunning sliver have a terminal face which is perpendicular to the running direction, and the respective end zones of the slivers have the full sliver thickness. Two cooperating, smooth-surface rolls define a pressure nip through which the slivers pass. It is a disadvantage of this arrangement that by placing the two terminal regions of the slivers side-by-side, along the region of such overlap the sliver thickness is doubled, that is, a thickened sliver zone is obtained which adversely affects further processing, and the drawing frames are generally not capable of evening out such thickened locations by regulation.

SUMMARY OF THE INVENTION

It is an object of the invention to provide an improved method and apparatus of the above-outlined type, from which the discussed disadvantages are eliminated and which, in particular, make possible a uniform splicing of the slivers and allow an improved further processing thereof.

This object and others to become apparent as the specification progresses, are accomplished by the invention, according to which, briefly stated, the apparatus for splicing a leading end of a first sliver deposited in a coiler can and a trailing end of an out-running second sliver fed into a fiber processing machine, includes a device for tapering the leading and trailing ends to obtain gradually tapered length portions thereof; a device for positioning the tapered length portions side by side to obtain a juxtapositioned relationship thereof; a pressure-applying constriction through which the first and second slivers pass for splicing together the leading and trailing ends by pressure; and a device for introducing the first sliver, spliced to the second sliver, into the fiber processing machine.

By virtue of the fact that—at least partially—the gradually tapered end portions of the two slivers are placed together, the fiber mass of the two slivers in the splicing zone is complemented essentially to the thickness of a single sliver. In contrast to the known arrangements, a pronounced thickened location is substantially or totally eliminated. The parallel orientation of the slivers remains substantially preserved even in the splicing zone. As a result, a uniform splicing of the sliver ends is achieved, and it is thus ensured that in the course of further processing of the fiber material a more uniform intermediate and finished product is obtained.

The invention has the following additional advantageous features:

- A stretching force is exerted to the side-by-side arranged sliver ends. In this manner, particularly in cases where the fiber mass at some locations of the coextensive sliver ends exceeds that of the single sliver, a reduction of thickness is achieved.
- The thinned (tapered) terminal portions of the slivers are formed by stretching the sliver ends lengthwise.
- The thinned terminal sliver portions are formed by combing the sliver ends.
- The sliver end portions are tapered along a length which, in case of staple fibers, corresponds to approximately 1–3 times the maximum fiber length.
- The terminal sliver portions have the shape of an oblique cut.
- A tongue-and-groove type roll pair is provided for strengthening (densifying) the splice zone.
- A sliver trumpet is provided for strengthening (densifying) the splice zone.
- The spliced sliver zone is sliver-shaped or approximately sliver-shaped to ensure that particularly when a tongue-and-groove type roll pair or a sliver trumpet is used, a continuous sliver structure is obtained, whereby a further processing, particularly in an after-connected drawing frame or a spinning machine, is rendered uniform to a substantial extent.
- A feed roll pair is positioned upstream of the sliver trumpet as viewed in the direction of sliver advance.
- A withdrawing (pull-off) roll pair is arranged downstream of the sliver trumpet as viewed in the direction of sliver advance.
- Parts of the sliver trumpet may be pivoted open to provide access to the inside of the trumpet for inserting the sliver thereinto.
- The rolls of the withdrawing roll pair are movable away from one another to facilitate a positioning of the sliver therebetween.
- The splicing zone of the sliver is advanced to the sliver trumpet by means of at least one feed roll pair which prepares the splicing zone for the splicing step performed in the sliver trumpet.
- The rolls of the feed roll pair are movable away from one another to facilitate a positioning of the slivers therebetween.
- The axes of the delivery rolls and supply rolls may assume different angles.
- Instead of feed rolls and withdrawing rolls stepped rolls are used.
- The sliver trumpet is provided with means for monitoring the uniformity of the splice.

The invention encompasses an advantageous apparatus for the automatic splicing and feeding of slivers to a drawing frame. The apparatus includes a device for capturing the leading end of the sliver deposited in a full coiler can, a mechanism for feeding the leading sliver end to and positioning it together with the trailing end of an out-running sliver and a device for splicing the two sliver ends. Advantageously, the apparatus is mounted on a movable carrier such as a carriage, a crab or the like.

The apparatus according to the invention has the following further advantageous features:

- The movable carrier is disposed underneath the longitudinal carrier of the in-feed table of the drawing frame.
- The device for capturing the trailing end of the deposited sliver is a suction device.
- A mechanism places the leading end of the sliver in the coiler can next to the loosely hanging trailing end of the out-running sliver.
- The loose trailing end of the run-out sliver may be moved by a suction device.
- The direction of rotation of the feed roll pair is reversible whereby the loosely hanging sliver end may be lengthened upon reverse run of the rolls or brought into a favorable position for splicing.
- A roll pair is provided for densifying the spliced zone. The rolls of the roll pair have an outer circumferential surface which is smooth, or shaped such that it is knurled, roughened or otherwise treated to improve the grasping of the fiber material.

DESCRIPTION OF THE PREFERRED EMBODIMENTS

Figure 1A:
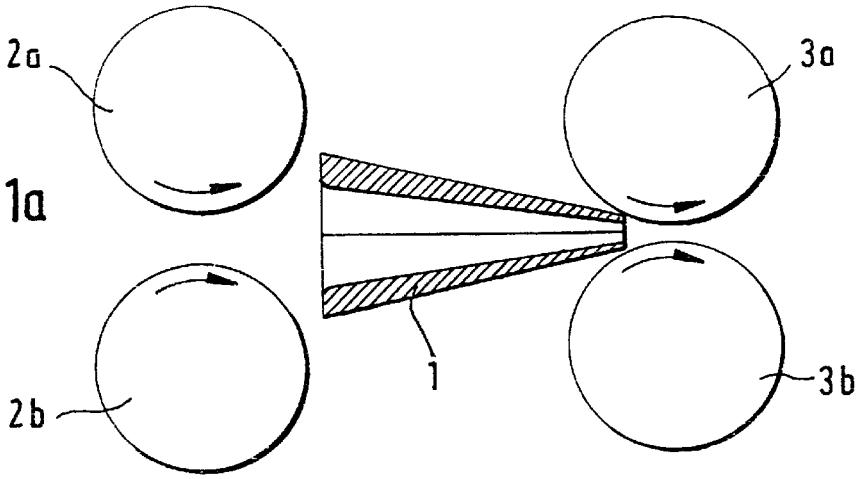
FIG. 1*a* is a schematic side elevational view of an apparatus according to the invention, including a sliver trumpet, a feed roll pair and a withdrawing roll pair in a closed position.

FIG. 1*a* shows a sliver trumpet 1 through which sliver is to pass from the left to the right. As viewed in such a direction of sliver advance, upstream of the trumpet 1 cooperating feed rolls 2*a,* 2*b,* and downstream of the trumpet 1 cooperating withdrawing rolls 3*a* and 3*b* are positioned. The direction of rotation of the rolls is indicated by the respective curved arrows drawn therein.

Figure 1B:
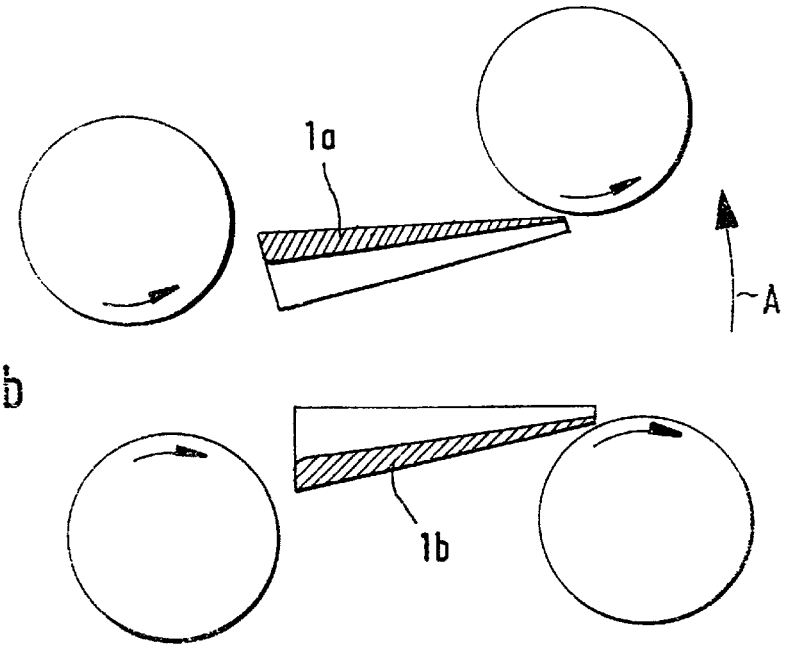
FIG. 1*b* is a view similar to FIG. 1*a,* showing the structure in an open position in which one-half of the sliver trumpet as well as one feed roll and one withdrawing roll are pivoted away into an open position.
Figure 2:
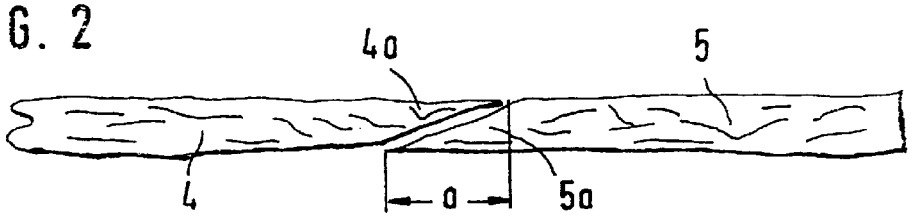
FIG. 2 shows a leading end of a deposited sliver and a trailing end of an out-running sliver having a tapered configuration and being longitudinally juxtapositioned.

Turning to FIG. 2, an end portion 4*a* of a sliver 4 and an end portion 5*a* of a sliver 5 are tapered and placed in an overlapping position in preparation for splicing of the sliver ends. The length of the taper is one to three times the maximum length of the fibers in the sliver. The tapering of the sliver ends is expediently effected by combing or by pulling the sliver ends apart along the sliver length. By means of the feed rolls 2*a,* 2*b* the tapered sliver zone is compressed (densified) such that it obtains a fiber lap-like character. The densifying (strengthening) of the splicing zone is effected by pulling the sliver through the sliver trumpet 1. The withdrawing roll pair 3*a,* 3*b* pulls off the sliver newly formed by the sliver trumpet 1. The apparatus operates without additional energy input, such as pressurized air and thus it may be utilized at any desired locations. The device excels by its simple construction. As concerns the sliver ends, no introduction of transverse structures is needed which would interfere with a subsequent drawing process. For positioning the sliver ends, the apparatus is pivoted upwardly as shown in FIG. 1*b*. For this purpose the sliver trumpet 1 is composed of two separable parts 1*a* and 1*b*. If an additional feed roll pair is used, a slight drawing of the sliver may be advantageously effected upstream of the sliver trumpet. If an additional withdrawing roll pair is used, the axes of the rolls of one withdrawing roll pair is preferably not parallel with the axes of the rolls of the other withdrawing roll pair. The sliver trumpet 1 is expediently so designed that the fiber material rolls in transversely to the sliver length before it reaches the opening of the trumpet 1. The withdrawing roll pair 3*a,* 3*b* or the sliver trumpet 1 may be provided with means for measuring the uniformity of the splice. Expediently, all that is determined is whether the successive drawing frame is or is not capable of evening any non-uniformity in the sliver.

The measures according to the invention ensure that the parallel orientation in the slivers is also maintained in the spliced zone. For this purpose, as illustrated in FIG. 2, in a first step the two tapered sliver ends 4*a* and 5*a* are prepared such that after bringing the slivers 4 and 5 together, the zone a to be spliced has no major dimensional deviations: the zone a has the same cross-sectional dimensions as the sliver 4 or the sliver 5 externally of the splice zone a. The sliver ends 4*a,* 5*a* are tapered and positioned on one another so that the two wedge-shaped sliver ends viewed at any cross section along the length of zone a complement one another. The length of the zone a should be at least twice the fiber length in the slivers. Thereafter the two slivers 4 and 5 are pressed together by an externally applied pressure which results in the densification of the slivers in the splice zone a.

During the densifying operation, in the sliver trumpet 1 additionally a certain draft may be produced which leads to a further densification by reorientation of the fibers. For this purpose, the extent of overlap of the tapered sliver band ends should be greater to provide an increased mass in the splice zone prior to the drawing operation. Such a thickening is subsequently reduced by the drawing operation.

Figure 3:
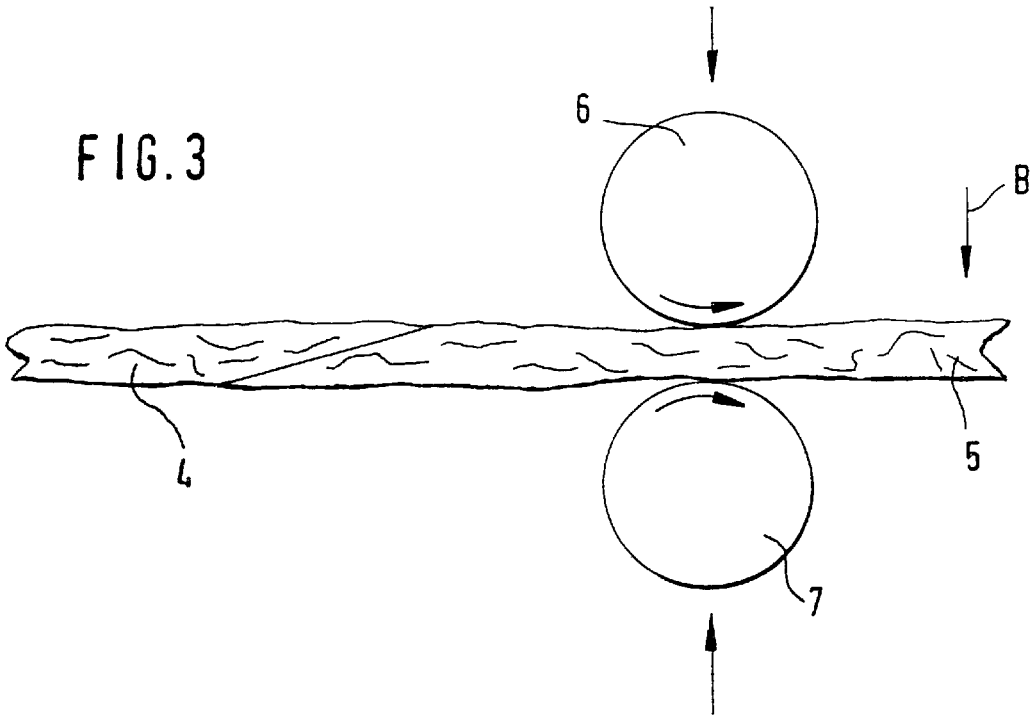
FIG. 3 is a schematic side elevational view of a densifying roll pair between which a splicing location of a running sliver is about to pass.

The pressure may be applied by cooperating rolls 6 and 7 as shown in FIG. 3. During this operation, the two rolls 6 and 7 may press in the direction B which lies in the plane of FIG. 3. A second roll pair may be provided which exerts a pressure in the transverse direction, that is, in a direction perpendicular to plane of FIG. 3.

Figure 4A:
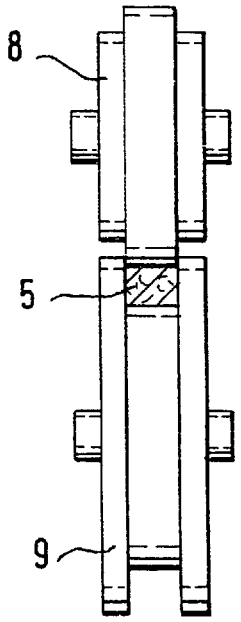
FIGS. 4*a* and 4*b* are respective front elevational and side elevational views of a sliver compressing, tongue-and-groove type roll pair.
Figure 4B:
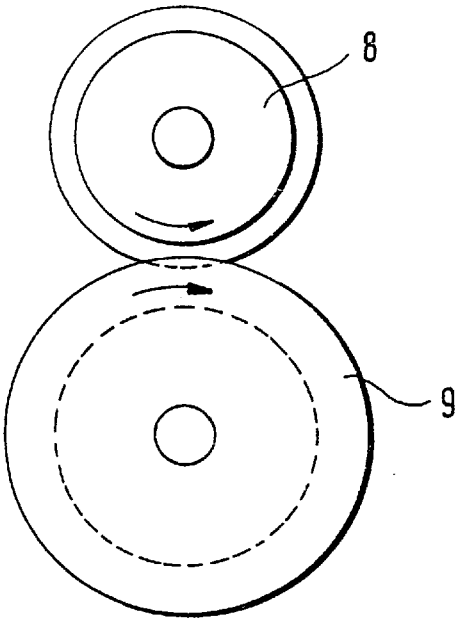

FIGS. 4*a*, 4*b* show a tongue-and-groove roll system composed of a roll 9 provided with a peripheral groove and a roll 8 provided with a peripheral tongue projecting into the groove of the roll 9. In this manner an omni-directional pressure is exerted on the fiber material.

Figure 5A:
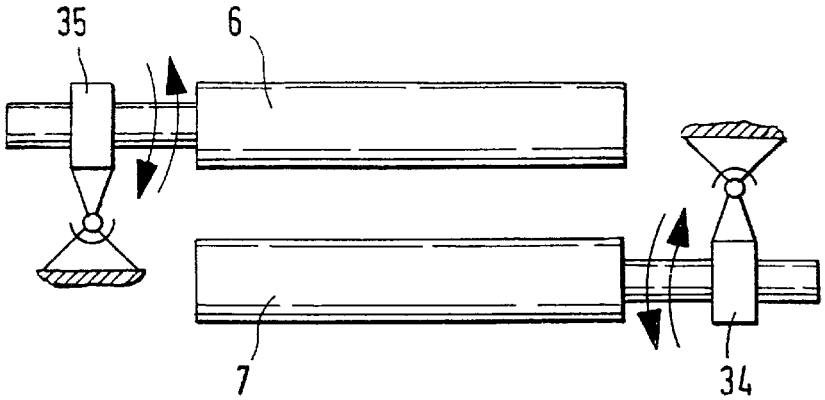
FIGS. 5*a,* 5*b* and 5*c* are front elevational views of a roll pair wherein the rolls are pivotally supported and wherein different pivotal positions of the rolls are illustrated.
Figure 5B:
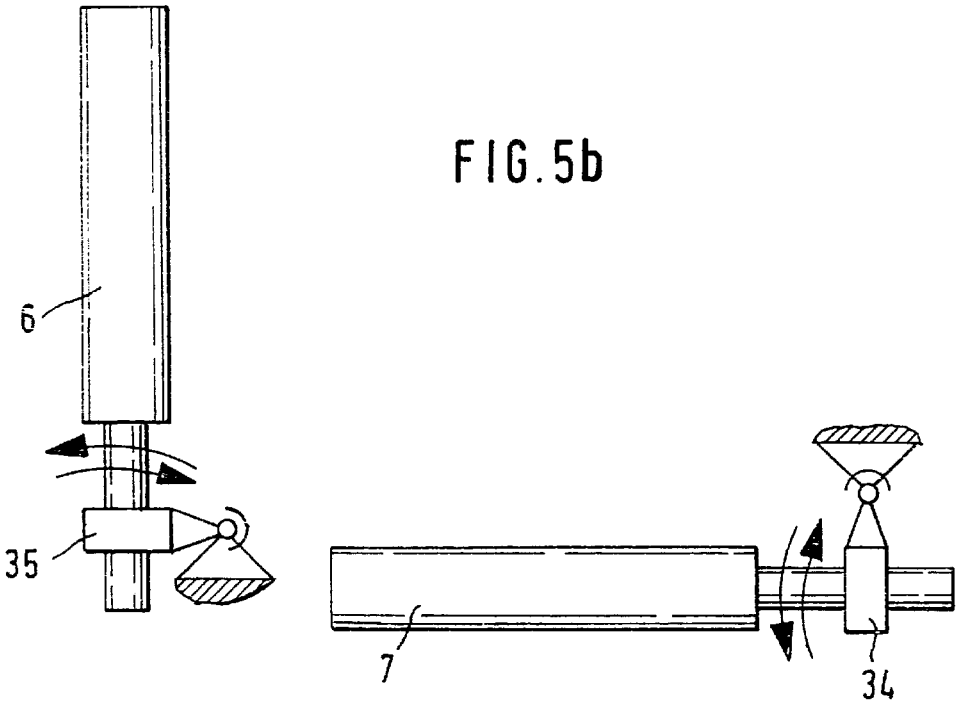
Figure 5C:
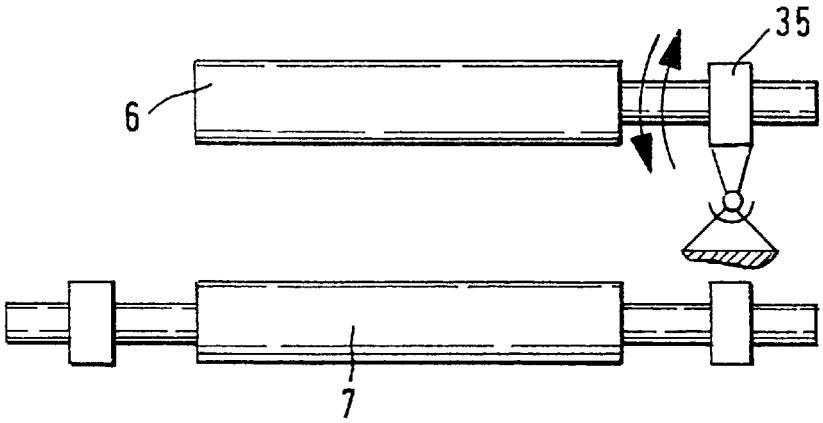

For introducing the prepared (endwise tapered) slivers into the densifying apparatus to perform the splicing operation, the rolls and the sliver trumpet may be made accessible by pivoting or linearly shifting open one of the rolls of the roll pair and one half of the sliver trumpet which, for this purpose, is of a split construction. As shown in FIGS. 5*a*, 5*b* and 5*c*, for the rolls 6 and 7, at least one roll of the roll pair has on one side a roll support which itself is pivotally held so that each roll pair may assume an upwardly pivoted (open) and a downwardly pivoted (closed) position.

Figure 6A:
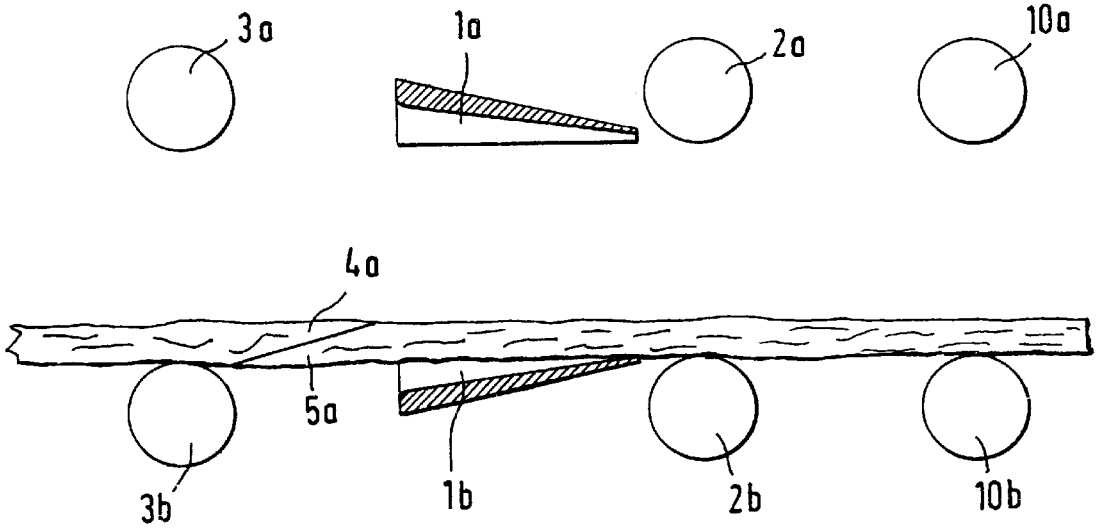
FIGS. 6*a,* 6*b* and 6*c* are schematic side elevational views, respectively illustrating the positioning, starting and operating phases involving the splicing and advancing of slivers.
Figure 6B:
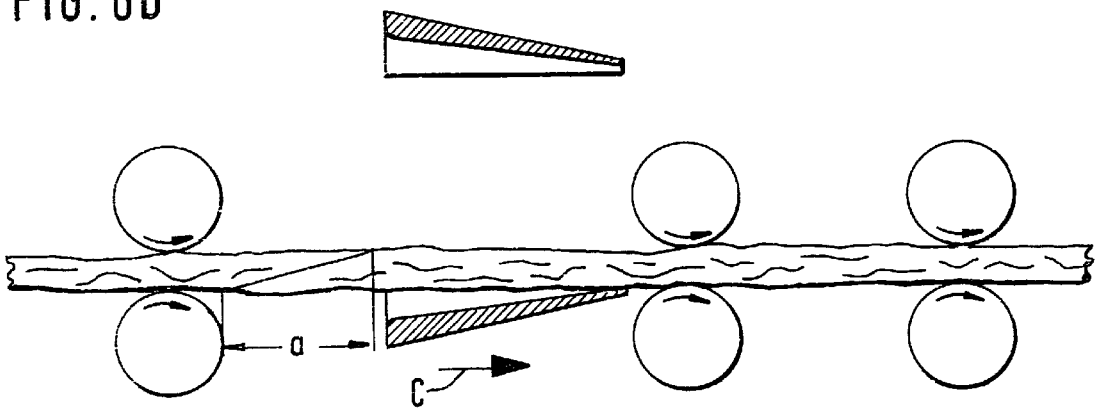
Figure 6C:
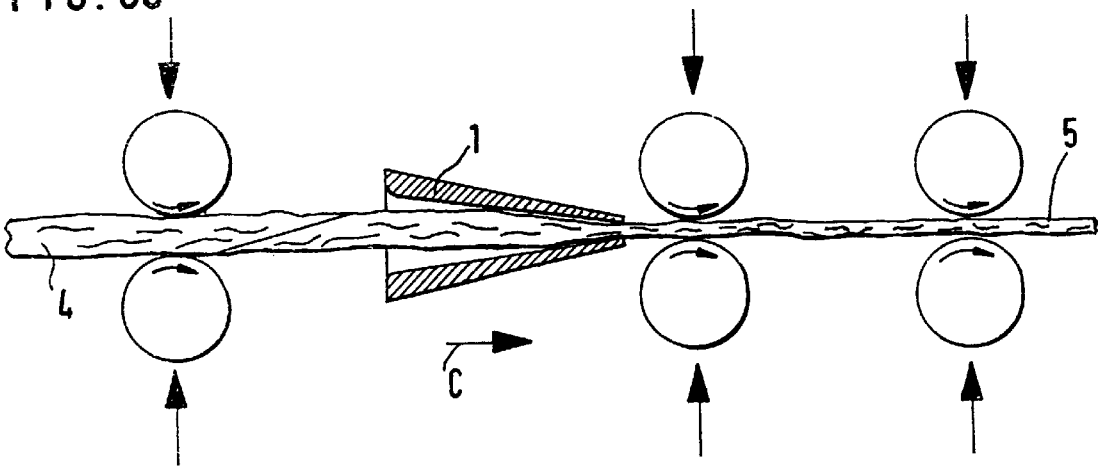

In FIG. 6*a* the feed roll pair 3*a*, 3*b*, the two halves 1*a*, 1*b* of the sliver trumpet 1, the withdrawing roll pair 2*a*, 2*b* and an additional withdrawing roll pair 10*a*, 10*b* are shown in the open position. The ends 4*a* and 5*a* of the slivers 4 and 5, respectively, are placed into the apparatus in a superposed position. Thereafter, as shown in FIG. 6*b*, the roll pairs 3*a*, 3*b*, 2*a*, 2*b* and 10*a*, 10*b* are closed and thus each roll pair engages, in its nip, one of the slivers 4 or 5. Then the rolls are rotated so that the slivers 4 and 5 slowly start their motion in the direction indicated by the arrow C. The closing of the densifying trumpet 1 occurs according to FIG. 6*c* expediently only after the slivers 4 and 5 are already in motion as advanced by the three transporting roll pairs.

Figure 7:
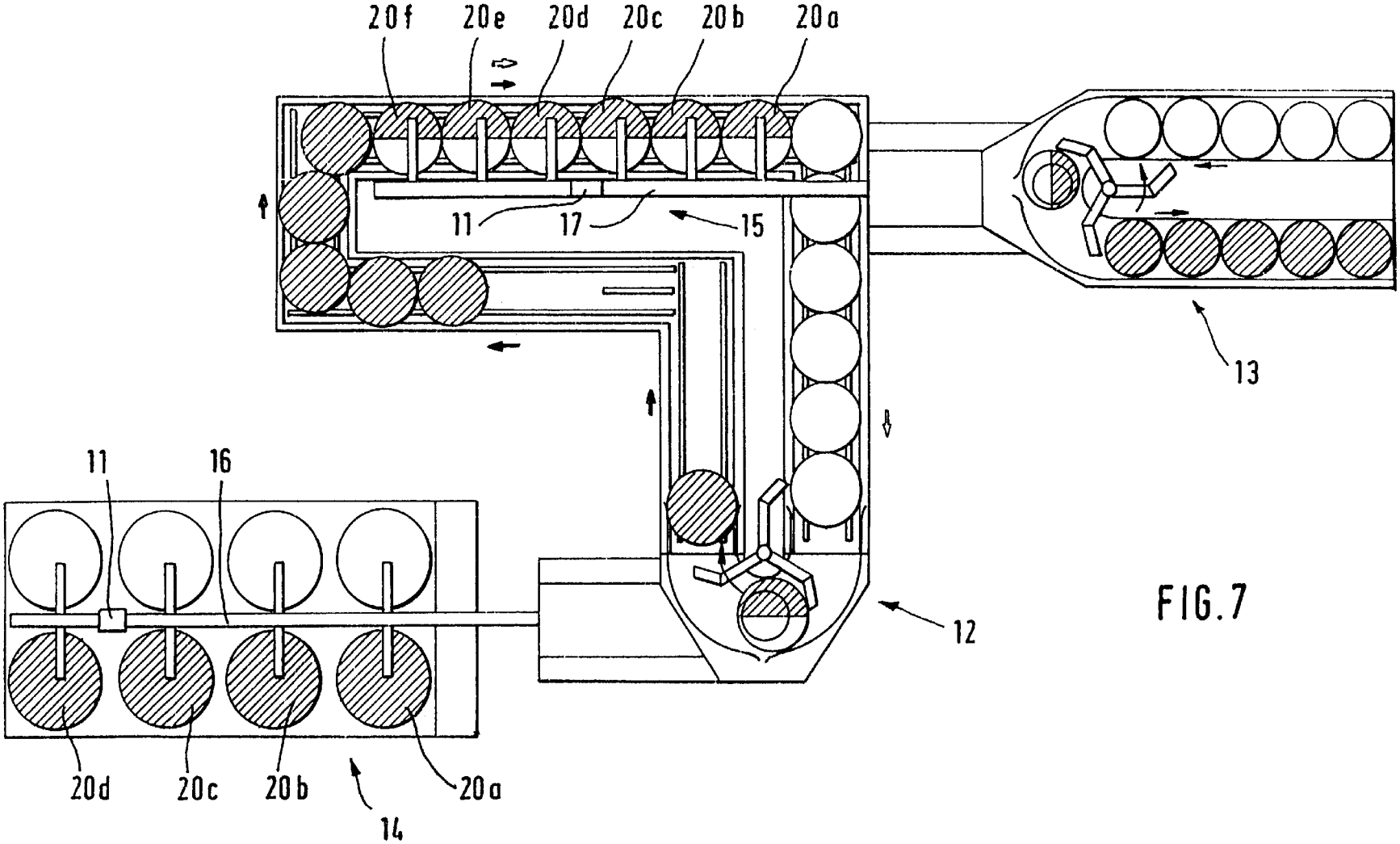
FIG. 7 is a schematic top plan view of a coiler can supply and removal system between two drawing frames.

Turning to FIG. 7, the apparatus 11 according to the invention is incorporated in a first drawing frame 12 and in a second drawing frame 13 of a drawing frame and coiler can transporting system as described in more detail in German Patent Application 197 22 536.5. One device 11 is mounted on the in-feed table 14 of the drawing frame 12 and another device 11 is mounted on the in-feed table 15 of the drawing frame 13.

Figure 8A:
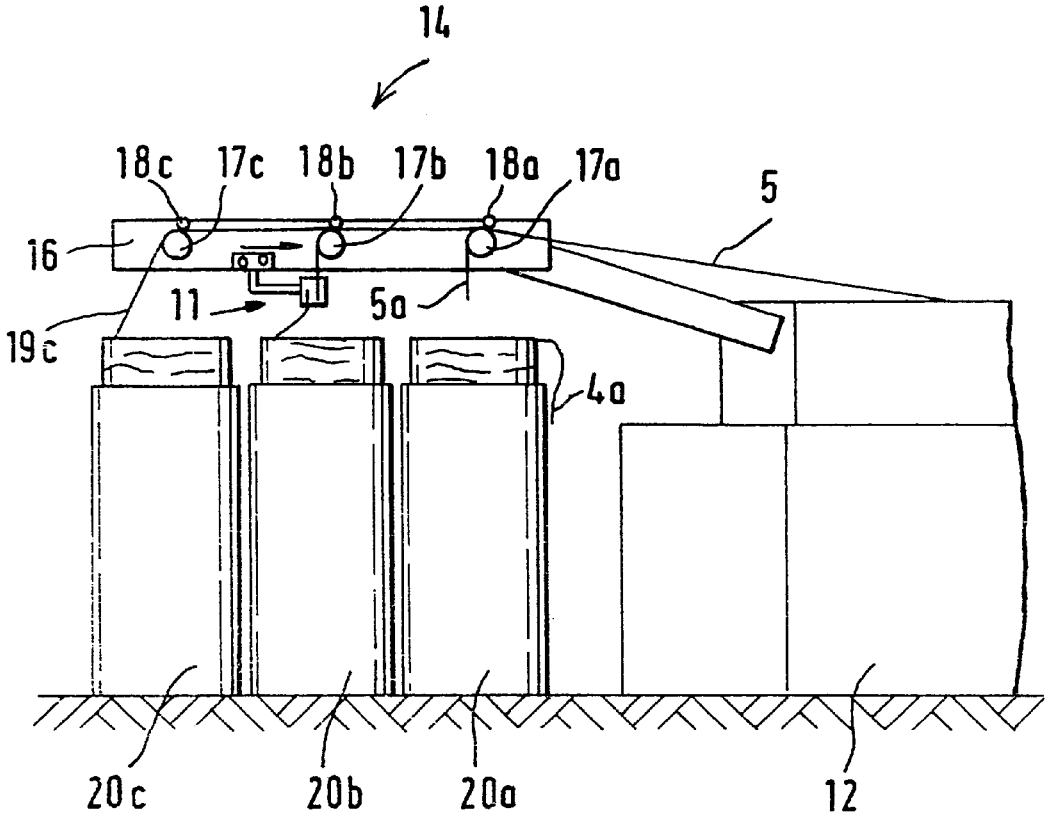
FIGS. 8*a* and 8*b* are respective schematic side elevational and top plan views of an in-feed table of a drawing frame, incorporating the invention.
Figure 8B:
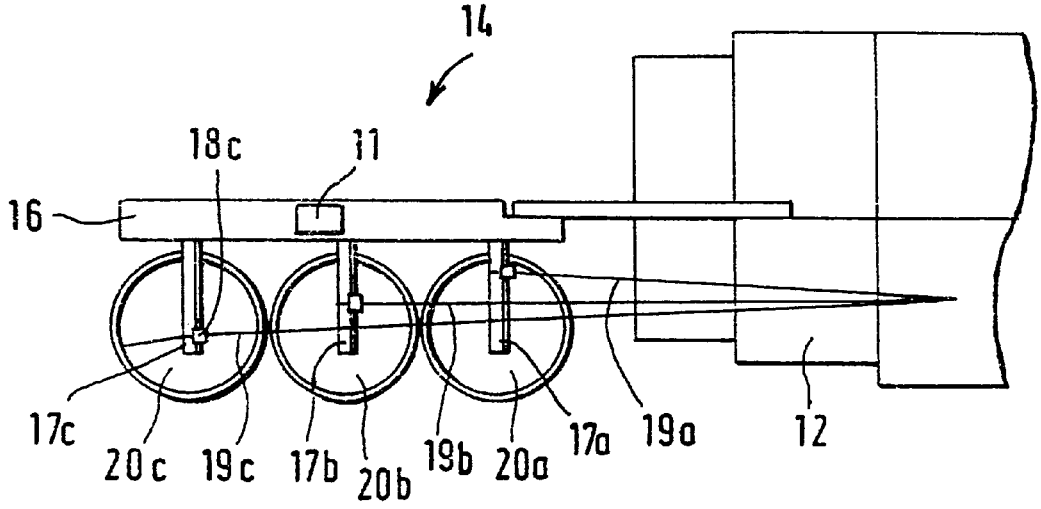

Also referring to FIGS. 8*a* and 8*b*, on the transverse carrier 16 of the in-feed table 14 a plurality of driven lower feed rolls 17*a*–17*c* are provided which cooperate with rotatable respective upper rolls 18*a*–18*c*. The feed rolls 17*a*–17*c* deliver the sliver from the coiler cans 20*a*—20*c* to the drawing frame 12. As shown in FIG. 8*a*, the trailing end 5*a* of the run-out sliver 5 hangs freely from the feed roll 17*a*, while a leading end 4*a* of the sliver 4 deposited in the full coiler can 20*a* hangs over the side thereof. Above the coiler can 20*b* and underneath the feed roll 17*b* two sliver ends 4*a* and 5*a* are spliced by the device 11. Between the coiler can 20*c* and the feed roll 17*c* an already-spliced sliver 19*c* is shown. FIG. 8*b* illustrates the slivers 19*a*, 19*b* and 19*c* between the feed rolls 17*a*, 17*b* and 17*c* on the one hand and the drawing frame 12, on the other hand. The device 11 is mounted on the transverse carrier 16 of the in-feed table 14.

Figure 9:
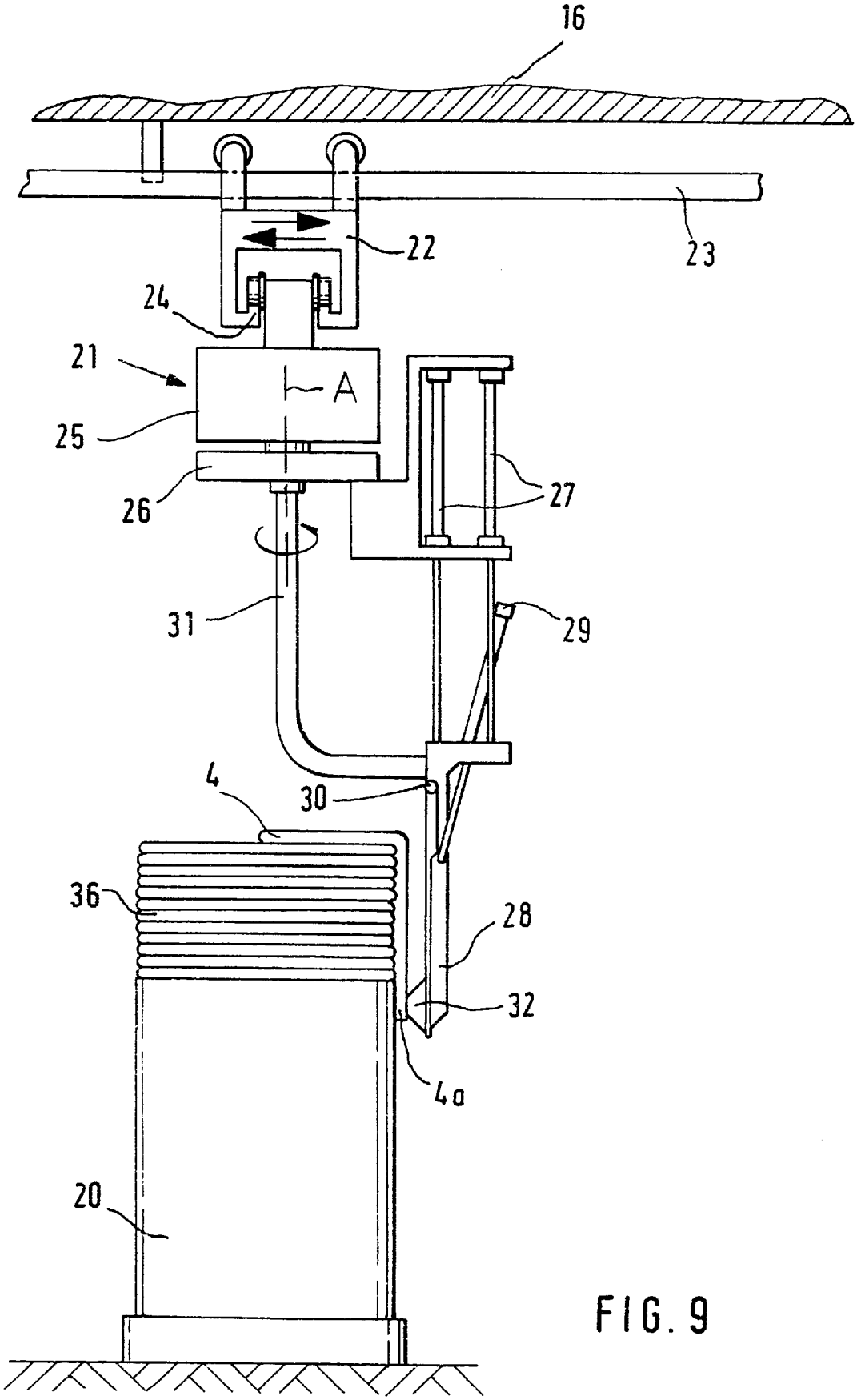
FIG. 9 is a schematic side elevational view of an apparatus according to the invention for capturing and positioning the leading end of sliver deposited in a coiler can.

The device 21 shown in FIG. 9 for receiving a new sliver 4 may be associated with a coiler can exchange system as shown in FIG. 7 and may cooperate with the in-feed table 15 and/or the in-feed table 14.

As illustrated in FIG. 9, a carriage 22 may travel above the coiler cans (for example, the cans 20*a*–20*c* of FIGS. 8*a*, 8*b*) on a rail system formed of longitudinal rails 23 and transverse rails 24 mounted on a transverse carrier 16 of the in-feed table 14. With the aid of the rail system the carriage 22 may be positioned over any one of the individual full coiler cans 20*a*–20*c* in a standby positions coaxially therewith. It is to be understood that the device may be used with other spinning preparation machines as well.

The carriage 22 is divided into a stationary part 25 and a part 26 which is rotatable about a vertical axis A. Two hydraulic cylinders 27 are vertically mounted on the rotatable part 26 at a radial distance from the rotary axis. At the end of the cylinders 27 an arm 28 formed as a gripper and a pivotal cylinder 29 are disposed. In FIG. 9, the arm 28 is shown in its vertically downwardly oriented position; the arm 28 may also assume a horizontal orientation. The pivot axis 30 of the arm 28 is disposed with respect to the rotary axis A of the device such that the arm 28 in its position shown in FIG. 9 is at a short distance from the external circumference of the full coiler can 20*a* situated underneath the carriage 22. Upon rotation of the device 21 about the axis A, the arm 28 orbits around the coiler can 20*a*. The length of the cylinder 27 is selected such that the arm 28 in the raised position may be pivoted into a horizontal orientation and then lowered into a position adjoining the sliver end 4*a* as shown.

In the carriage 22 a non-illustrated suction device is disposed which, by means of a suction hose 31, is coupled to a suction opening 32 which is situated at a free end of the arm 28 and which is oriented towards the rotary axis A. Further, the arm 28 is coupled with a clamping and separating (rupturing) device, not shown.

In the description which follows, the mode of operation of the can exchanging device of FIG. 7 and the associated splicing device 21 of FIG. 9 will be described in further detail. It is assumed that the full coiler cans 20*a*–20*c* to be brought onto the emplacement under the transverse carrier 16 of the in-feed table 14 are prepared in a preceding process step and are transferred to the coiler can exchange device and further, that the sliver contained therein is provided with a leading sliver end 4*a* which freely hangs over the outer side of the full coiler can 20*a* as shown, for example, in FIG. 9.

As soon as the coiler cans which supply sliver to the drawing frame and which are situated underneath the in-feed table 14 are almost empty, that is, when, for example, the trailing sliver ends of the sliver withdrawn from the cans lie on the in-feed table, the drawing mechanism (drawing unit) of the drawing frame and thus the supply of the slivers to the drawing frame is stopped. First, that empty coiler can is replaced by a full can which is the farthest from the drawing unit. Thereafter, the empty coiler cans are consecutively pushed out of their working position and the full coiler cans are moved into the working position, replacing the empty cans.

The carriage 22 is positioned coaxially above the full coiler can 20*a*; the arm 28 is situated between the full coiler can 20*a* and the transverse carrier 16 of the in-feed table 14. By rotating the component 26, the vertically oriented, lowered arm 28 orbits once about the full coiler can 20*a* about the axis A and, with the aid of a suction stream generated by a suction device and passing through the opening 32, captures the leading sliver end 4*a* of the sliver 4 contained in the full coiler can 20*a*. The sliver end 4*a* is drawn into the suction opening 32; this occurrence is recognized by a sensor, such as an optical barrier. The suction opening 32 may also be used for thinning (tapering) the sliver end 4*a*. The leading sliver end 4*a* is firmly clamped by the non-illustrated clamping device mounted on the arm 28 and with the aid of a separating device is shortened to a predetermined extent. Thereafter, the arm 28 is, by the lifting cylinder 27 and the pivot cylinder 29, consecutively raised, pivoted outwardly and again lowered. After these movements the arm 28, together with the captured leading sliver end 4*a* is situated above the trailing sliver end 5*a* on the in-feed table 16.

Figure 10:
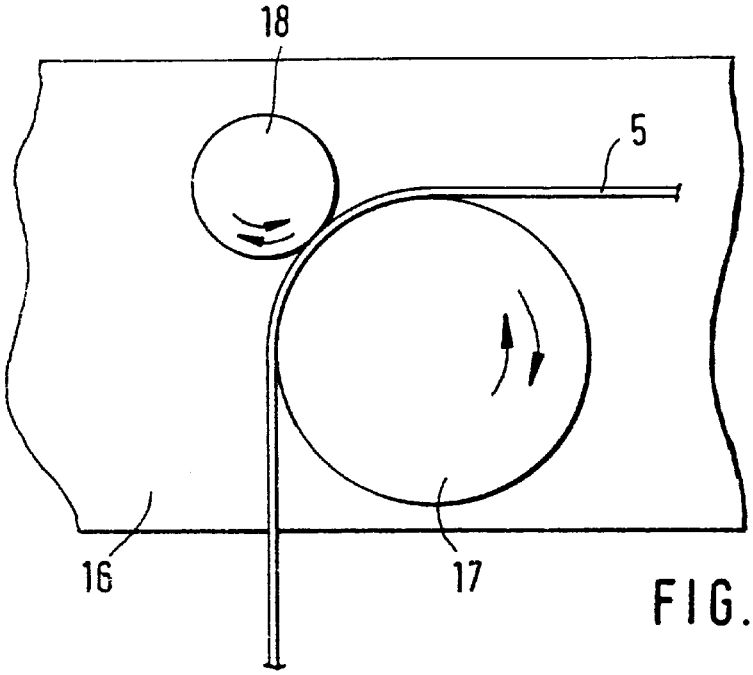
FIG. 10 is a schematic side elevational view of a roll pair composed of a feed roll and an upper roll, both selectively rotatable in the one or other direction.

The stoppage of the drawing unit before the coiler can exchange and the above-described positioning of the slivers are coordinated in such a manner that the trailing sliver ends 5*a* of the "old" slivers and the leading sliver ends 4*a* of the "new" slivers are at least partially in an overlapping relationship along an exactly determinable length. It is also feasible to pull the leading sliver ends 4*a* from the full coiler cans by the arm 28 by virtue of a motion of the carriage 22 to a location above a non-illustrated positioning device and deposited thereon. The respective trailing sliver ends 5*a* of the out-running sliver are also placed on the positioning device. As a result of such an arrangement, the leading ends 4*a* of the "new" slivers have an exact initial position during splicing. The position of the trailing end 5*a* of the out-running sliver may also be set by the rotation of the feed roll 17 in a suitable forward or reverse direction as shown in FIG. 10. After the sliver ends 4*a* and 5*a* are superposed in the described manner, they are spliced by applying pressure by means of the device according to the invention and described earlier.

Figure 11:
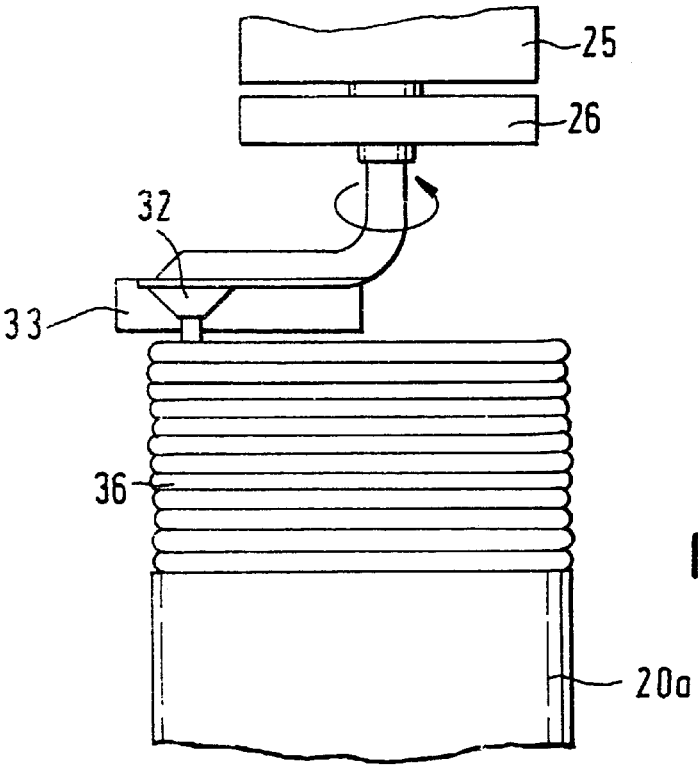
FIG. 11 is a schematic side elevational view of a device according to the invention for receiving and positioning a leading end of sliver deposited in a coiler can.

The rotatable part 26 of the carriage 22 may, as shown in FIG. 11, be structured such that a leading sliver end 4*a* lying on the top surface of the sliver fill 36 is searched, captured and, if necessary, transported. For this purpose, a suction element 32 for the free end may be provided with a hold-down device 33 for the sliver coils of the sliver fill 36.

The apparatus according to the invention may also be used in an automatic coiler can transporting vehicle.

After treatment by the device 21, the splicing location a (FIG. 2) is linearly passed through the sliver trumpet 1. The densification occurs within the sliver trumpet 1 and, if required, in conjunction with the successive rotating withdrawing rolls 3*a*, 3*b*. In case a groove-and-tongue type roll pair 8, 9 is used, the densification is performed only by rotating components.

It will be understood that the above description of the present invention is susceptible to various modifications, changes and adaptations, and the same are intended to be comprehended within the meaning and range of equivalents of the appended claims.

What is claimed is:

1. A method of splicing a leading end of a first sliver deposited in a coiler can and a trailing end of an out-running second sliver fed into a fiber processing machine, comprising the following steps:

(a) tapering said leading and trailing ends to obtain gradually tapered length portions thereof;

(b) positioning the tapered length portions side by side to obtain a juxtapositioned relationship thereof;

(c) after step (b), passing said first and second slivers through a pressure-applying constriction of a sliver trumpet for splicing together said leading and trailing ends while having said juxtapositioned relationship; and (d) after step (c), introducing said first sliver, spliced to said second sliver, into said fiber processing machine.

2. The method as defined in claim 1, further comprising the step of drafting said length portions during the passage thereof through said sliver trumpet.

3. The method as defined in claim 1, wherein step (a) comprises the step of pulling said leading and trailing ends apart.

4. The method as defined in claim 1, wherein step (a) comprises the step of combing said leading and trailing ends.

5. The method as defined in claim 1, wherein the length of each said length portion equals 1–3 times a maximum fiber length of the fibers forming said first and second slivers.

6. The method as defined in claim 1, further comprising the following steps performed simultaneously with step (c):

(e) passing the first sliver through a feed roll pair situated adjacent and upstream of said sliver trumpet as viewed in a direction of sliver run;

(f) passing the second sliver through a withdrawing roll pair situated adjacent and downstream of said sliver trumpet; and (g) drafting the first and second slivers by and between said feed roll pair and said withdrawing roll pair.

7. An apparatus for splicing a leading end of a first sliver deposited in a coiler can and a trailing end of an out-running second sliver fed into a fiber processing machine, comprising (a) means for tapering said leading and trailing ends to obtain gradually tapered length portions thereof;

(b) means for positioning the tapered length portions side by side to obtain a juxtapositioned relationship thereof;

(c) a sliver trumpet having a pressure-applying constriction through which said first and second slivers pass for splicing together by pressure said leading and trailing ends while having said juxtapositioned relationship; and (d) means for introducing said first sliver, spliced to said second sliver, into said fiber processing machine.

8. The apparatus as defined in claim 7, further comprising sensor means for monitoring a uniformity of the splice between said first and second slivers.

9. The apparatus as defined in claim 7, further comprising sensor means for monitoring the splice for uniformity between said first and second slivers; said sensor means being provided in said sliver trumpet.

10. The apparatus as defined in claim 7, wherein said sliver trumpet has a longitudinally split construction formed of sliver trumpet halves movable into operative and open positions; said slivers being placeable into said sliver trumpet in the open position thereof.

11. The apparatus as defined in claim 7, further comprising a feed roll pair for advancing the slivers to said sliver trumpet; said feed roll pair being situated upstream of said sliver trumpet as viewed in a direction of sliver advance therethrough.

12. The apparatus as defined in claim 11, further comprising means for moving one of the rolls of the feed roll pair relative to the other roll of said feed roll pair for placing said feed roll pair into open and closed positions; in said closed position said feed roll pair defining a nip line and in said open position of said feed roll pair said slivers being placeable thereinto.

13. The apparatus as defined in claim 11, further comprising a withdrawing roll pair for pulling said slivers through said sliver trumpet; said withdrawing roll pair being situated downstream of said sliver trumpet.

14. The apparatus as defined in claim 13, further comprising means for moving one of the rolls of the withdrawing roll pair relative to the other roll of said withdrawing roll pair for placing said withdrawing roll pair into open and closed positions; in said closed position said withdrawing roll pair defining a nip line and in said open position of said withdrawing roll pair said slivers being placeable thereinto.

15. A fiber processing system comprising (a) a fiber processing machine having an inlet for inputting a running sliver thereinto;

(b) an emplacement for receiving a coiler can filled with sliver having a loosely positioned leading end;

(c) an apparatus for splicing said leading end and a trailing end of the running sliver fed into said fiber processing machine; said apparatus including (1) means for tapering the leading and trailing ends to obtain gradually tapered length portions thereof;

(2) means for positioning the tapered length portions side by side to obtain a juxtapositioned relationship thereof; and (3) a sliver trumpet having a pressure-applying constriction through which the slivers pass for splicing together by pressure the leading and trailing ends while having the juxtapositioned relationship.

16. The fiber processing system as defined in claim 15, further comprising means for positioning said apparatus above said emplacement, in alignment with the coiler can.

17. The fiber processing system as defined in claim 15, wherein said apparatus further comprises a suction device for capturing the leading end of the sliver contained in the coiler can.

18. The fiber processing system as defined in claim 15, wherein said apparatus further comprises (4) capturing means for capturing the leading end of the sliver contained in the coiler can;

(5) searching means for searching for the leading end; and (6) positioning means for positioning said capturing means next to the leading end of the sliver.

19. The fiber processing system as defined in claim 18, wherein said searching means and said positioning means together comprise a mechanism carrying said capturing means; said mechanism including (a) a carrier member; and (b) a rotatable assembly mounted on said carrier member for rotation about an axis alignable with the coiler can; said assembly including a holder carrying said capturing means and orbitable about the coiler can to find the trailing end hanging over a side of the coiler can.

* * * * *